US009761359B2

(12) United States Patent
Nakanishi et al.

(10) Patent No.: US 9,761,359 B2
(45) Date of Patent: Sep. 12, 2017

(54) METHOD OF PRODUCING ELECTRICAL STEEL SHEET

(71) Applicant: JFE Steel Corporation, Tokyo (JP)

(72) Inventors: Tadashi Nakanishi, Tokyo (JP); Yoshiaki Zaizen, Tokyo (JP); Yoshihiko Oda, Tokyo (JP); Hiroaki Toda, Tokyo (JP)

(73) Assignee: JFE Steel Corporation (JP)

( * ) Notice: Subject to any disclaimer, the term of this patent is extended or adjusted under 35 U.S.C. 154(b) by 553 days.

(21) Appl. No.: 14/379,653

(22) PCT Filed: Feb. 21, 2013

(86) PCT No.: PCT/JP2013/000967
§ 371 (c)(1),
(2) Date: Aug. 19, 2014

(87) PCT Pub. No.: WO2013/125223
PCT Pub. Date: Aug. 29, 2013

(65) Prior Publication Data

US 2015/0027590 A1 Jan. 29, 2015

(30) Foreign Application Priority Data

Feb. 23, 2012 (JP) ..... 2012-037682

(51) Int. Cl.
*H01F 1/04* (2006.01)
*H01F 1/147* (2006.01)
(Continued)

(52) U.S. Cl.
CPC ..... *H01F 1/14775* (2013.01); *C21D 8/1222* (2013.01); *C21D 8/1233* (2013.01);
(Continued)

(58) Field of Classification Search
CPC .... H01F 1/14775; H01F 1/14791; H01F 1/16; C21D 8/1261; C21D 8/1222;
(Continued)

(56) References Cited

U.S. PATENT DOCUMENTS 5,181,972 A * 1/1993 Komatsubara ..... C21D 8/1233 148/111
5,798,001 A * 8/1998 Anderson ..... C21D 8/1233 148/112
(Continued)

FOREIGN PATENT DOCUMENTS

CN 102618790 A * 8/2012
EP 2 031 079 3/2009
(Continued)

OTHER PUBLICATIONS

Machine translation of JP-2012136764A (no date available).*
(Continued)

*Primary Examiner* — Kiley Stoner
(74) *Attorney, Agent, or Firm* — DLA Piper LLP (US)

(57) ABSTRACT

A method produces a high strength electrical steel sheet in which a cumulative rolling reduction ratio in rough rolling is 73.0% or more, in which in a hot band annealing step, an annealing condition is selected that satisfies an area ratio of recrystallized grains after hot band annealing of 100%, and a recrystallized grain size of 80 μm to 300 μm, under a condition where annealing temperature is 850° C. to 1000° C., and annealing duration is 10 seconds to 10 minutes, and in which in a final annealing step, an annealing condition is selected that satisfies an area ratio of recrystallized grains after the final annealing of 30% to 95%, and a length in the rolling direction of a connected non-recrystallized grain
(Continued)

group of 2.5 mm or less, under a condition where annealing temperature is 670° C. to 800° C., and annealing duration is 2 seconds to 1 minute.

8 Claims, 2 Drawing Sheets

(51) Int. Cl.

| | |
|---|---|
| ***C22C 38/00*** | (2006.01) |
| ***C22C 38/60*** | (2006.01) |
| ***H01F 1/16*** | (2006.01) |
| ***C21D 8/12*** | (2006.01) |
| ***C22C 38/02*** | (2006.01) |
| ***C22C 38/04*** | (2006.01) |
| ***C22C 38/06*** | (2006.01) |
| *C21D 9/46* | (2006.01) |

(52) U.S. Cl.
CPC ..... *C21D 8/1261* (2013.01); *C21D 8/1272* (2013.01); *C22C 38/00* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/60* (2013.01); *H01F 1/14791* (2013.01); *H01F 1/16* (2013.01); *C21D 9/46* (2013.01)

(58) Field of Classification Search
CPC ..... C21D 8/1272; C21D 8/1233; C21D 9/46; C22C 38/06; C22C 38/001; C22C 38/002; C22C 38/008; C22C 38/02; C22C 38/04; C22C 38/004; C22C 38/00; C22C 38/60
USPC ..... 148/110–112
See application file for complete search history.

(56) References Cited

U.S. PATENT DOCUMENTS

| | | | | |
|---|---|---|---|---|
| 6,231,685 | B1 * | 5/2001 | Anderson | C21D 8/1233 148/111 |
| 6,524,726 | B1 * | 2/2003 | Kitano | C21D 8/0426 148/337 |
| 2001/0037841 | A1 | 11/2001 | Murakami et al. | |
| 2004/0154708 | A1 * | 8/2004 | Takahashi | C21D 8/0468 148/610 |
| 2005/0000596 | A1 * | 1/2005 | Schoen | C21D 8/1205 148/111 |
| 2009/0202383 | A1 | 8/2009 | Tanaka et al. | |
| 2010/0218857 | A1 * | 9/2010 | Nakagaito | C21D 8/04 148/533 |
| 2011/0198002 | A1 * | 8/2011 | Nakagaito | C22C 38/02 148/533 |
| 2012/0040203 | A1 * | 2/2012 | Takagi | C21D 8/0405 428/577 |

FOREIGN PATENT DOCUMENTS

| | | | | |
|---|---|---|---|---|
| EP | 2 385 147 | | 11/2011 | |
| FR | WO 2012153009 | A1 * | 11/2012 | C21D 6/005 |
| JP | 60-238421 | | 11/1985 | |
| JP | 62-112723 | | 5/1987 | |
| JP | 02-008346 | | 1/1990 | |
| JP | 02-022442 | | 1/1990 | |
| JP | 2001-234303 | | 8/2001 | |
| JP | 2005-113185 | | 4/2005 | |
| JP | 2007-186790 | | 7/2007 | |
| JP | WO 2007111080 | A1 * | 10/2007 | B21B 3/00 |
| JP | 2010-090474 | | 4/2010 | |
| JP | 2012-136763 | | 7/2012 | |
| JP | 2012-136764 | | 7/2012 | |
| KR | 711474 | B1 * | 4/2007 | |
| KR | 711481 | B1 * | 4/2007 | |

OTHER PUBLICATIONS

Machine translation of JP-2012136763A (no date available).*
English translation of the Notification of Reasons for Refusal of corresponding JP 2013-537354 dated Dec. 17, 2013.
Supplementary European Search Report dated Jul. 22, 2015 of corresponding European Application No. 13752273.6.

* cited by examiner

METHOD OF PRODUCING ELECTRICAL STEEL SHEET

TECHNICAL FIELD

This disclosure relates to a method of producing an electrical steel sheet having high strength and excellent fatigue properties, as well as excellent magnetic properties, which is suitably used for parts where a large stress is applied, typical examples of such parts being rotors for turbine generators, or high speed rotation equipment such as driving motors for electric automobiles and hybrid automobiles, and motors for machine tools.

BACKGROUND

In recent years, the development of driving systems for motors has made frequency control of driving power possible, and the use of motors for variable speed operation or high speed rotation exceeding commercial frequency is growing. In such motors for high speed rotation, the centrifugal force applied to a rotating body such as a rotor is proportional to the rotating radius and increases proportionally to the square value of rotational speed. Therefore, it is necessary for rotor material, in particular rotor material for high speed motors of middle and large sizes, to have high strength.

Further, in an IPM (Interior Permanent Magnet)-type DC inverter controlled motor which is increasingly being adopted in driving motors for hybrid automobiles or compressor motors in recent years, a slit is provided on the outer periphery part of the rotor and a magnet is embedded therein. Because of this, stress concentrates in narrow bridge parts (e.g. parts between an outer periphery of a rotor, and a slit) due to centrifugal force during high speed rotation of the motor. Further, since the stress state varies depending on the acceleration/deceleration operation or vibration of the motor, high fatigue strength as well as high strength are required for core material used in rotors.

In addition, in high speed motors, eddy current is generated by a high frequency magnetic flux, and heating is caused as motor efficiency lowers. As this heat value increases, the magnet embedded within the rotor is demagnetized. For this reason, it is also required for the iron loss in the high frequency area to be low.

Therefore, an electrical steel sheet with high strength having excellent magnetic properties as well as excellent fatigue properties is desired as material for rotors.

As methods of strengthening steel sheets, solid solution strengthening, precipitation strengthening, crystal grain refinement strengthening, and multi-phase strengthening are known. However, since many of these strengthening methods deteriorate magnetic properties, it is generally considered extremely difficult to improve both strength and magnetic properties.

Under such situation, some proposals for an electrical steel having high tensile strength have been made.

For example, JPS60-238421A proposes a method of enhancing the strength of steel sheets by increasing the Si content to 3.5% to 7.0% and adding elements such as Ti, W, Mo, Mn, Ni, Co, and Al for solid solution strengthening.

Further, JPS62-112723A proposes, in addition to the above described strengthening method, a method of improving magnetic properties by devising conditions of final annealing and achieving a crystallized grain size of 0.01 mm to 5.0 mm.

However, when these methods were applied to factory production, there were problems such as the fact that troubles including sheet fracture were likely to occur during a continuous annealing process after hot rolling, or the subsequent rolling process and the like, and reduction in yield or line stop was unavoidable.

Regarding this point, changing the cold rolling process to a warm rolling process with the sheet temperature set to several hundred degrees would reduce sheet fracture. However, not only will it be necessary to adapt facilities to warm rolling but there are serious problems of process management including a large restriction of production.

Further, JPH02-22442A proposes a method of achieving solid solution strengthening by adding Mn and Ni to steel with an Si content of 2.0% to 3.5%, and JPH02-8346A proposes a technique of achieving both high strength and magnetic properties by performing solid solution strengthening with the addition of Mn or Ni to steel with an Si content of 2.0% to 4.0%, and using carbonitrides of Nb, Zr, Ti, V, and the like.

However, those methods have problems such as the necessity of adding a large amount of expensive elements such as Ni, or the high cost due to the reduction in yield caused by an increase of defects such as scab. Further, to date, sufficient research has not been conducted to investigate fatigue properties of materials obtained by these disclosed techniques.

Further, as a high strength electrical steel sheet focused on fatigue resistance properties, JP2001-234303A discloses a technique of achieving a fatigue limit of 350 MPa or more by controlling the crystallized grain size depending on the steel composition of the electrical steel sheet with an Si content of 3.3% or less.

However, with that method, the achievement level of the fatigue limit itself was low and could not satisfy the recently required level, e.g. a fatigue limit strength of 500 MPa or more.

On the other hand, JP2005-113185A and JP2007-186790A propose a high strength electrical steel sheet with non-recrystallized grains remaining on the steel sheet. According to those methods, high strength can be obtained relatively easily while maintaining manufacturability after hot rolling.

However, through an evaluation we performed on stability of mechanical properties of such material with non-recrystallized grains remained, we identified that the material tends to have a large variation in its mechanical properties. In other words, we identified that, although high mechanical properties are exhibited in average, even relatively small stress may cause fracture in a short time due to the large variation.

Such large variation in mechanical properties makes it necessary to improve the worst mechanical properties among varied mechanical properties, so that they have the required mechanical properties. It is understood that one method for this would be to improve the average mechanical properties. However, when material with a non-recrystallized microstructure remained, it is necessary to increase the amount of non-recrystallized microstructure by lowering the temperature of final annealing. Although this will not eliminate the variation of mechanical properties itself, troubles such as fracture can be prevented by improving relatively poor mechanical properties.

However, in the case of lowering the temperature of final annealing to increase the amount of non-recrystallized microstructure, an increase in iron loss was caused.

In other words, a large variation of mechanical properties makes an increase of iron loss unavoidable.

Therefore, reducing the variation in mechanical properties is also effective for the reduction of iron loss.

As mentioned above, by using conventional techniques under present circumstances, it is extremely difficult to stably provide a high strength electrical steel sheet having high strength, and excellent magnetic properties and manufacturability, which is a material with a small variation of mechanical strength, at a low cost.

There is, therefore, a need to provide an advantageous method of producing an electrical steel sheet stably having high strength and high fatigue properties, and excellent magnetic properties, which is suitable for use as rotor material for high speed motors.

SUMMARY

We conducted an examination on mechanical strength and fatigue properties of a high strength electrical steel sheet utilizing a non-recrystallized and recovered microstructure, and studied producing conditions to reduce variation in mechanical strength and fatigue strength, and obtaining good manufacturability.

As a result, we discovered that precipitates that inhibit growth of crystal grains, in particular the microstructure after hot band annealing and final annealing has a great influence on the variation of mechanical properties, and that the addition of Ca is effective to achieve good manufacturability. Further, we discovered that it is effective to control the cumulative rolling reduction ratio in rough rolling during hot rolling, in particular the rolling reduction ratio at final pass in rough rolling.

We thus provide:

1. A method of producing an electrical steel sheet, the method comprising:

heating a slab consisting of a chemical composition including by mass %

C: 0.0050% or less,

Si: more than 3.5% and 5.0% or less,

Mn: 0.10% or less,

Al: 0.0020% or less,

P: 0.030% or less,

N: 0.0040% or less,

S: 0.0005% or more and 0.0030% or less, and

Ca: 0.0015% or more, and further at least one element selected from

Sn: 0.01% or more and 0.1% or less, and

Sb: 0.01% or more and 0.1% or less, balance being Fe and incidental impurities;

then subjecting the slab to hot rolling consisting of rough rolling and finish rolling to obtain a hot rolled steel sheet;

subjecting the steel sheet to subsequent hot band annealing and pickling;

then subjecting the steel sheet to a single cold rolling to have a final sheet thickness; and then subjecting the steel sheet to final annealing to produce a high strength electrical steel sheet, wherein a cumulative rolling reduction ratio of rough rolling in the hot rolling is 73.0% or more, wherein in the hot band annealing step, an annealing condition is selected that satisfies an area ratio of recrystallized grains in a cross section in a rolling direction of the steel sheet after the hot band annealing of 100%, and a recrystallized grain size of 80 pm or more and 300 p.m or less, under a condition where annealing temperature is 850° C. or higher and 1000° C. or lower, and annealing duration is 10 seconds or longer and 10 minutes or shorter, and wherein in the final annealing step, an annealing condition is selected that satisfies an area ratio of recrystallized grains in a cross section in the rolling direction of the steel sheet after the final annealing of 30% or more and 95% or less, and a length in the rolling direction of a connected non-recrystallized grain group of 2.5 mm or less, under a condition where annealing temperature is 670° C. or higher and 800° C. or lower, and annealing duration is 2 seconds or longer and 1 minute or shorter.

2. The method of producing an electrical steel sheet according to aspect 1, wherein a rolling reduction ratio of final pass in the rough rolling is 25% or more.

3. The method of producing an electrical steel sheet according to aspects 1 or 2, wherein an average grain size of recrystallized grains in a cross section in the rolling direction of the steel sheet after the final annealing is 15 μm or more.

4. The method of producing a high strength electrical steel sheet according to any one of aspects 1 to 3, wherein a rolling reduction ratio in the cold rolling is 80% or more.

It is possible to obtain an electrical steel sheet with high strength and low iron loss, which also stably exhibits high fatigue strength, under good manufacturability.

BRIEF DESCRIPTION OF THE DRAWINGS

Our methods and steel sheets will be further described below with reference to the accompanying drawings, wherein.

DETAILED DESCRIPTION

Figure 1:
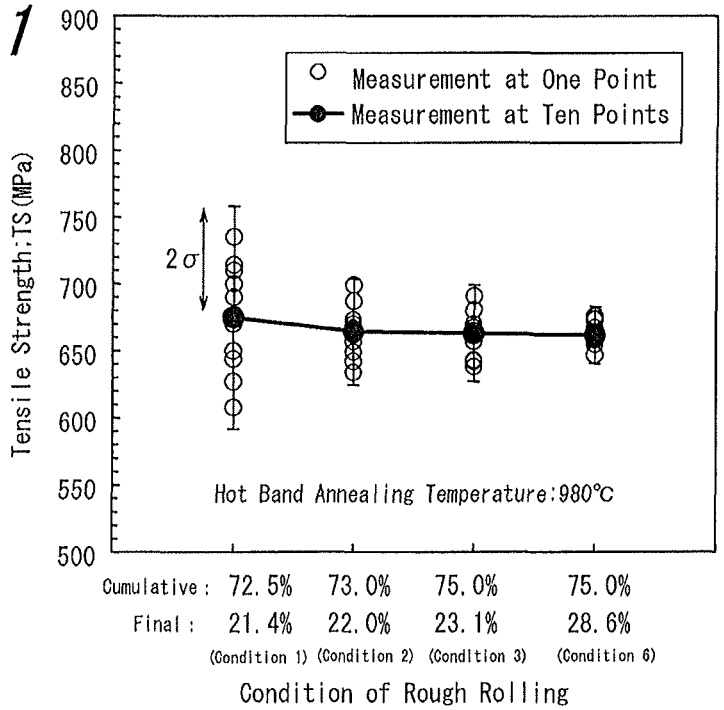
FIG. 1 is a graph showing the influence of rolling reduction ratio of hot rough rolling on tensile strength.

Details are described below.

First, we investigated the fundamental cause of the variation in properties. Variation in properties means either that the properties vary in the sheet transverse and rolling directions of a product steel sheet, or that there is a difference in properties of two products produced with similar production conditions. Regarding production conditions, for example, the final annealing temperature is not exactly a constant temperature, and varies in the sheet transverse and rolling directions. Further, the temperature is not exactly the same in different coils. Components in the slab also vary.

We believe that such variation of temperature and components in producing conditions cause variation in properties of products. Therefore, to reduce variation in properties of a product, variation in producing conditions should be reduced. However, there is a limit in reducing variation of producing conditions.

We concluded that a producing method that reduces variation in properties of products is a method that does not cause variation in properties of products even when the production conditions vary as described above.

We believe that due to the variation in producing conditions as described above, the nature of the material in the manufacturing process is most influenced by the state of precipitates in the material.

Precipitates affect the growth of crystal grains during hot band annealing or final annealing. In other words, it affects the crystalline structure of the product steel sheet. Therefore, since it is extremely important to control the recrystallization ratio in a high strength electrical steel sheet utilizing a non-recrystallized and recovered microstructure, we believe that reducing variation in the state of precipitates would be effective in reducing variation in properties of the products.

To reduce the variation in the state of precipitates, possible methods would be coarsening precipitates by increasing the amount thereof, or being in a state where precipitates hardly exist in the material.

We decided to adopt the method of creating a state where precipitates hardly exist. This is because we thought that, not only is the state where precipitates hardly exist advantageous in terms of iron loss reduction, but the good grain growth properties of the product steel sheet also enable using the material as a semi-processed material.

From the above, we thought that, by reducing the amount of precipitates in materials, variation in properties of the products would be reduced. We thus conducted experiments using steel slabs, each having a composition with minimized amounts of Mn, Al, S, C, and N, to reduce as much sulfide or nitride as possible.

Specifically, the composition includes 3.65% of Si, 0.03% of Mn, 0.0005% of Al, 0.02% of P, 0.0019% of S, 0.0018% of C, 0.0019% of N, and 0.04% of Sn. Unless otherwise specified, the indication of "%" regarding components shall stand for "mass%".

However, after heating the above steel slabs at 1100° C., a problem arose in that fractures occurred in some of the materials during hot rolling to a thickness of 2.0 mm. To determine the cause of the fractures, an investigation was made on the fractured partly hot rolled material, and as a result, the concentration of S was observed in the cracked parts. Since no concentration of Mn was found in the S concentration part, we believe that the concentrated S formed into FeS in liquid phase during hot rolling, and caused the fracture.

To prevent such fractures, the S content should be reduced. However, for production reasons, there is a limit in reducing the S content. Further, desulfurization causes an increase in cost. On the other hand, although it is possible to increase the amount of Mn to fix S as MnS, a precipitated MnS is a precipitate with a strong inhibiting effect on crystal grain growth, as evident from the fact that it is used as an inhibitor in a grain-oriented electrical steel sheet.

As a solution to this problem, we used Ca to allow S to precipitate as CaS which has a small influence on crystal grain growth, it would be possible to prevent fractures during hot rolling, and reduce the variation in properties of the product steel sheet. Based on this approach, the following experiment was conducted.

A steel slab containing 3.71% of Si, 0.03% of Mn, 0.0004% of Al, 0.02% of P, 0.0021% of S, 0.0018% of C, 0.0020% of N, 0.04% of Sn, and 0.0030% of Ca was heated at 1100° C., and then subjected to rough rolling in hot rolling until reaching a thickness of 2.0 mm in various conditions shown in table 1. The obtained hot rolled sheet was subjected to hot band annealing under various conditions shown in table 1, and then after pickling, the hot rolled sheet was subjected to cold rolling until reaching a sheet thickness of 0.35 mm, and then to final annealing at temperatures shown in Table 1. Appearance of the hot rolled sheet was examined during the process of the experiment, and no cracks were found.

TABLE 1

| Condition | Cumulative Rolling Reduction Ratio of Rough Rolling (%) | Rolling Reduction Ratio of Final Pass in Rough Rolling (%) | Hot Band Annealing Temperature (° C.) | Final Annealing Temperature (° C.) | Recrystallization Ratio After Hot Band Annealing (%) | Recrystallized Grain Size After Hot Band Annealing (μm) |
|---|---|---|---|---|---|---|
| 1 | 72.5 | 21.4 | 980 | 720 | 100 | 270 |
| 2 | 73.0 | 22.0 | 980 | 720 | 100 | 275 |
| 3 | 75.0 | 23.1 | 980 | 720 | 100 | 280 |
| 4 | 75.0 | 28.6 | 820 | 720 | 75 | 27 |
| 5 | 75.0 | 28.6 | 900 | 720 | 100 | 100 |
| 6 | 75.0 | 28.6 | 980 | 720 | 100 | 280 |
| 7 | 75.0 | 28.6 | 1060 | 720 | 100 | 480 |

From these samples, JIS No. 5 tensile test pieces were collected, in particular five sheets in a rolling direction and five sheets in a transverse direction (direction orthogonal to the rolling direction) for each condition, and were subjected to a tensile test.

Figure 2:
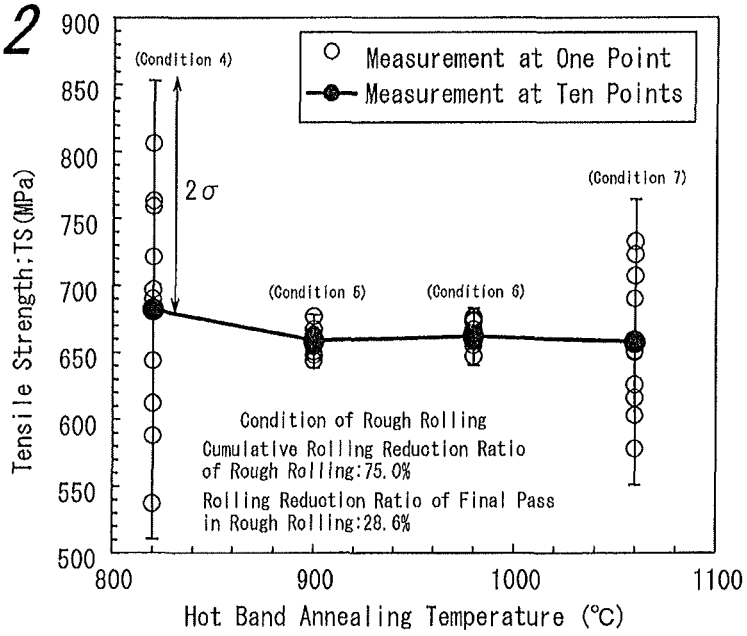
FIG. 2 is a graph showing the influence of temperature of hot band annealing on tensile strength.

Regarding the results thereof, the relation between the rolling reduction ratio of hot rough rolling and tensile strength is shown in FIG. 1, and the relation between hot band annealing temperature and tensile strength is shown in FIG. 2. Further, variation of tensile strength was evaluated with standard deviation σ, and FIGS. 1 and 2 show the range of ±2σ.

As shown in FIGS. 1 and 2, samples of all of the conditions exhibited an average tensile strength of 650 MPa or more which is an extremely high strength compared to a normal electrical steel sheet. However, the degree of variation significantly differs depending on the conditions of rough rolling and/or hot band annealing. Condition 1 with a low cumulative rolling reduction ratio of rough rolling as shown in FIG. 1, condition 4 with a low hot band annealing temperature and condition 7 with a high hot band annealing temperature as shown in FIG. 2, showed a large variation in tensile strength.

Next, regarding these samples, the cold-rolled and annealed sheets were sectioned in the rolling direction and embedded in resin, and the cross sections were polished for microstructure observation.

As a result, all of the samples had a recrystallization ratio of 60% to 80%, and consisted of a mixed structure of recrystallized and non-recrystallized microstructures. Regarding the non-recrystallized part, although it is difficult to make an accurate discrimination, we believe that some microstructures elongated by cold rolling original crystal grains after hot band annealing were connected together to form an elongated microstructure group.

Regarding steel sheets of conditions 1, 4 and 7, we determined that the length in the rolling direction of this non-recrystallized grain group tends to be longer than steel sheets of other producing conditions. Therefore, it was assumed that this difference in form of microstructure is the main cause of increasing variation of properties.

For verification, the microstructures after hot band annealing were retraced. Condition 4 is a mixed microstructure of a rolled microstructure elongated by hot rolling and a recrystallized microstructure, and the average grain size of the recrystallization part was 27 μm. Further, conditions 1 to 3, and 5 to 7 are microstructures of only recrystallized microstructures, and their average grain size were as follows. Condition 1: 270 μm, Condition 2: 275 μm, Condition 3: 280 μm, Condition 5: 100 μm, Condition 6: 280 μm, and Condition 7: 480 μm Therefore, we concluded that it is an important requirement in suppressing variation in properties to increase cumulative rolling reduction ratio in the rough rolling during hot rolling, achieve a recrystallization ratio after hot band annealing of 100%, and produce a microstructure after hot band annealing so that recrystallized grains are kept fine.

We also discovered that, in addition to this control of the microstructure after hot band annealing, appropriately controlling cold rolling conditions is important in controlling the microstructure during annealing of the cold rolled sheet. Based on the above discoveries, we succeeded in developing a high strength electrical steel sheet having excellent magnetic properties, mechanical properties and fatigue properties, and including a non-recrystallized and recovered microstructure which is highly effective in suppressing variation of properties.

Next, reasons for limiting the steel components to the aforementioned composition range will be explained.

C: 0.0050% or Less

Although C has an effect of enhancing strength by precipitation of carbide, it has an adverse impact on the variation in magnetic properties and mechanical properties of the products. Since the enhancement of strength of steel sheets is achieved mainly by utilizing solid solution strengthening of substitutional element of Si and a non-recrystallized and recovered microstructure, the content of C is limited to 0.0050% or less.

Si: More Than 3.5% and 5.0% or Less

Not only is Si commonly used as a deoxidizer for steel, but it also has an effect of increasing electric resistance and reducing iron loss and, therefore, it is a main element constituting an electrical steel sheet. Since other solid-solution-strengthening elements such as Mn, Al, and Ni are not used herein, Si is positively added to steel as a main element for solid-solution-strengthening, in an amount of more than 3.5%. The content of Si is preferably 3.6% or more. However, if the Si content exceeds 5.0%, manufacturability decreases to such an extent that a crack is generated during cold rolling. Therefore, the upper limit is 5.0%. The content of Si is desirably 4.5% or less.

Mn: 0.10% or Less

Mn is a harmful element that not only interferes with domain wall displacement when precipitated as MnS, but deteriorates magnetic properties by inhibiting crystal grain growth. The content of Mn is limited to 0.10% or less to reduce the variation of magnetic properties of the products.

Al: 0.0020% or Less

Al, as well as Si, is commonly used as a deoxidizer for steel, and has a large effect of increasing electric resistance and reducing iron loss. Therefore, it is usually used as a main constituent element of a non-oriented electrical steel sheet. However, since the nitride content should be minimized to reduce the variation in mechanical properties of the products, the content of Al is limited to 0.0020% or less.

P: 0.030% or Less

Since P provides a significant solid solution strengthening ability with a relatively small additive amount, it is extremely effective in enhancing strength of steel sheets. The content of P is preferably 0.005% or more to obtain such an effect. On the other hand, excessively adding P leads to intergranular cracking or a decrease in rollability due to embrittlement caused by segregation and, therefore, the content of P is limited to 0.030% or less.

N: 0.0040% or Less

N, as is the case with the aforementioned C, causes deterioration of magnetic properties, and increases variation of mechanical properties of the products and, therefore, the content of N is limited to 0.0040% or less.

S: 0.0005% or More and 0.0030% or Less

The sulfide content must be minimized to reduce variation in mechanical properties of the products and, therefore, the content of S is limited to 0.0030% or less. In a non-oriented electrical steel sheet, S is generally a harmful element that not only forms sulfide such as MnS and interferes with domain wall displacement, but also deteriorates magnetic properties by inhibiting crystal grain growth. Therefore, minimizing the content of S contributes to improving magnetic properties. Nevertheless, an increase in cost caused by desulfurizing must be suppressed. Therefore, the content of S is 0.0005% or more.

At least one selected from Sn: 0.01% or more and 0.1% or less, and Sb: 0.01% or more and 0.1% or less Sn and Sb both have an effect of improving texture and increasing magnetic properties. However, to obtain such an effect, it is necessary to add 0.01% or more of each component, in either case of independent addition or combined addition of Sb and Sn. On the other hand, excessively adding these components can cause embrittlement of steel, and increase the possibility of sheet fracture and the occurrence of scabs during producing of the steel sheet. Therefore, the content of each of Sn and Sb is 0.1% or less in either case of independent addition or combined addition. The content of both components is preferably 0.03% or more and 0.07% or less.

Ca: 0.0015% or More

The content of Mn is smaller than a normal non-oriented electrical steel sheet. Therefore, Ca fixes S within the steel and prevents generation of FeS in liquid phase, and provides good manufacturability at the time of hot rolling. It is necessary to add 0.0015% or more of Ca to obtain such an effect. However, since an excessively large additive amount would increase cost, the upper limit is preferably about 0.01%.

By applying essential components and inhibiting components such as described above, it is possible to reduce the variation in the state of precipitates, which affect growth properties of crystal grains and, therefore, the variation in mechanical properties of the products can be reduced.

Other elements are preferably reduced to a degree that does not cause any problem in production since they would otherwise increase the variation in mechanical properties of the products. Other elements include O, V, Nb and Ti. These elements are preferably reduced to 0.005% or less, 0.005% or less, 0.005% or less, and 0.003% or less, respectively.

Next, the reason for limiting the form of microstructure of the steel sheet is described.

The high strength electrical steel sheet is constituted of a mixed structure of recrystallized grains and non-recrystallized grains. It is important that this structure is appropriately controlled to ensure proper dispersion of the non-recrystallized grain group.

First, it is necessary to control the area ratio of recrystallized grains of the steel sheet after final annealing so that the cross sectional-structure in the rolling direction (structure in a cross section orthogonal to the sheet transverse direction) of the steel sheet is 30% or more to 95% or less. If the recrystallization area ratio is less than 30%, iron loss increases, while if the recrystallization ratio exceeds 95%, sufficiently advantageous strength compared to known non-oriented electrical steel sheets cannot be obtained. The recrystallization ratio is more preferably 65% to 85%.

Further, it is important to ensure that the length in the rolling direction of a connected non-recrystallized grain group in a steel sheet after final annealing is 2.5 mm or less.

A connected non-recrystallized grain group is a lump of non-recrystallized grains forming an elongated microstructure where several microstructures elongated by rolling elongated crystal grains with different crystal orientations after hot rolling and/or elongated crystal grains with different crystal orientations after hot band annealing, are linked together. The connected non-recrystallized grain group is observed in the cross sectional structure in the rolling direction, and defined by the mean value of the measured lengths in the rolling direction of 10 or more non-recrystallized grain groups. Suppressing the length of the non-recrystallized group to 2.5 mm or less will reduce variation in mechanical properties of the products, and enable producing material stably having high strength and high fatigue properties. The length of the non-recrystallized group is more preferably 0.2 mm to 1.5 mm.

Although the reason is not necessarily clear, we believe that the interface of the rolled elongated microstructure of non-recrystallized grains has an influence on cracks.

This non-recrystallized grain group has a shape compressed in a sheet thickness direction and elongated in the rolling and transverse directions. The steel sheet contains a mixture of a non-recrystallized grain group and recrystallized grains. Since the non-recrystallized grain group and the recrystallized grains have significantly different mechanical properties, when a crack is generated by tensile stress, the crack propagates along the boundaries of the non-recrystallized grain group and the recrystallized grains, and causes a fracture. Since precipitates hardly form in the steel sheet produced by our methods, we believe that cracks are less likely to be generated along the boundaries of the non-recrystallized grain group and the recrystallized grains than in a high strength electrical steel sheet utilizing a normal non-recrystallized and recovered microstructure where precipitates are present. However, it is also the case that, if the non-recrystallized grain group is coarse, stress concentration in the tip of the non-recrystallized grain group increases and causes an increase in variation of mechanical properties.

Regarding this point, if the length in the rolling direction of the connected non-recrystallized grain group is within the above range, it is possible to appropriately adjust the recrystallization ratio to 30% to 95% depending on the required strength level. In other words, the recrystallization ratio can be adjusted so that the recrystallization ratio is lowered if the required strength level is high, and the recrystallization ratio is increased if greater importance is placed on magnetic properties. As described above, the strength level depends mainly on the ratio of non-recrystallized microstructure. On the other hand, to improve magnetic properties, it is effective to increase the average grain size of the recrystallized grains. The average grain size is preferably 15 μm or more. Further, the upper limit of average grain size is preferably about 100 μm. The average grain size is more preferably 20 μm to 50 μm Next, the reason for limiting the production method and the structure of the intermediate of the process is described.

Production of a high strength electrical steel sheet can be carried out using the process and equipment applied for producing a normal non-oriented electrical steel sheet.

An example of such process would be subjecting a steel, which is obtained by steelmaking in a converter or an electric furnace to have a predetermined chemical composition, to secondary refining in a degassing equipment, and to blooming after continuous casting or ingot casting, to obtain a steel slab, and then subjecting the steel slab to hot rolling, hot band annealing, pickling, cold rolling, final annealing, and applying and baking insulating coating thereon.

To obtain the desirable steel structure, it is important for the production conditions to be controlled as described below.

First, at the time of hot rolling, the reheating temperature is preferably set to 1000° C. or higher and 1200° C. or lower. In particular, if slab reheating temperature becomes high, not only is it uneconomical because of the increase in energy loss, but the high temperature strength of the slab decreases, which makes it more likely for troubles in production such as sagging of the slab to occur. Therefore, the temperature is preferably 1200° C. or lower.

Further, to reduce the variation of the mechanical properties of the product steel sheet, the cumulative rolling reduction ratio of rough rolling is set to be 73.0% or more. At this time, the rolling reduction ratio of final pass in rough rolling is preferably 25% or more. Further, the rolling reduction ratio of final pass in rough rolling is preferably lower than 50%.

Although the reason why the rolling reduction ratio of rough rolling has an influence on the variation of mechanical properties is not necessarily clear, we believe it is as follows. The temperature at which the slab heated to the above slab reheating temperature is subjected to rough rolling is higher than the recrystallization temperature. Therefore, if the rolling reduction ratio of rough rolling is set to 73% or more, crystal grains which were elongated in rough rolling recrystallize between the time after rough rolling and before finish rolling. For this reason, we believe that elongated grains of the hot rolled sheet decrease to make the size and shape of the crystal grains after final annealing uniform and, therefore, the variation in mechanical properties is reduced.

Hot rolling normally consists of rough rolling where a high temperature slab of approximately 100 mm to 300 mm thick is worked into a bar of intermediate thickness referred to as a rough bar having a thickness of approximately 20 mm to 70 mm by several passes of rolling, and finish rolling where the rough bar is worked by tandem rolling until reaching the sheet thickness of a hot rolled sheet. Finish rolling as used herein refers to tandem rolling where a material is worked into the thickness of a hot rolled sheet, while lying continuously on a path from the first to final passes of the tandem rolling. Therefore, the length of time during which the material stays in between the passes of the finish rolling is short, whereas the length of time during which the material stays in between the final pass of the rough rolling and the first pass of the finish rolling is long.

Further, rough rolling may be tandem rolling or single rolling, or a combination of both. In single rolling, reverse rolling may be applied. Before and after, or during rough rolling, it is also possible to reduce the dimension of the material in the transverse direction using vertical rolls without any problem.

The rolling reduction ratio of the final pass in rough rolling is preferably 25% or more. We believe that this is because, when the cumulative rolling reduction ratio of rough rolling is the same, a larger rolling reduction ratio of the final pass facilitates recrystallization and reduces elongated grains in the hot rolled sheet and, therefore, reduces variations in mechanical properties. However, when the rolling reduction ratio of the final pass in rough rolling is 50% or more, the angle of bite increases and makes rolling difficult. Therefore, the rolling reduction ratio of the final pass in rough rolling is preferably lower than 50%.

To obtain a microstructure after final annealing, it is necessary for the microstructure of after hot band annealing to have a recrystallization ratio of 100%, and the average grain size of the recrystallized grain to be 80 μm or more and 300 μm or less.

To achieve the above described steel structure, it is necessary for the temperature of hot band annealing to be 850° C. or higher and 1000° C. or lower.

The reason is that if the annealing temperature is lower than 850° C., it is difficult to stably achieve a recrystallization ratio of 100% after hot band annealing, while if the annealing temperature exceeds 1000° C., there will be cases where the average recrystallized grain size after hot band annealing exceeds 300 μm. Further, in a steel with a small amount of precipitates, precipitates dissolve in solid solutions when the annealing temperature exceeds 1000° C., which in turn form precipitates in grain boundaries on cooling. Therefore, there is an adverse effect on the growth of crystal grains.

Further, from the perspective of stably achieving a recrystallization ratio of 100%, it is necessary to set the annealing duration to 10 seconds or longer, while from the perspective of achieving an average recrystallized grain size of 300 μm or less, it is necessary to set the annealing duration to 10 minutes or shorter.

Under the above described condition with an annealing temperature of 850° C. or higher and 1000° C. or lower, and annealing duration of 10 seconds or longer and 10 minutes or shorter, an annealing condition where the area ratio of recrystallized grains in the cross section in the rolling direction of the steel sheet after hot band annealing is 100%, and the recrystallized grain size is 80 μm or more and 300 μm or less, is selected.

The reason for setting the recrystallization ratio of the microstructure after hot band annealing to 100% is because if a worked microstructure remains after hot band annealing, recrystallization behavior at the time of final annealing after cold rolling would be different between the part of the worked microstructure and the part where recrystallization occurred after hot band annealing, and therefore causes variation in crystal orientation etc. after final annealing and leads to an increase in variation of mechanical properties of the product steel sheet.

Next, after the above described hot band annealing, a so-called "single-stage" cold rolling process which achieves a final sheet thickness in a single cold rolling, is applied to carry out cold rolling. The rolling reduction ratio at this time is preferably 80% or more. This is because when the rolling reduction ratio is lower than 80%, the amount of recrystallization nucleus required at the time of the subsequent final annealing becomes insufficient, and causes difficulty of appropriately controlling the dispersion of the non-recrystallized microstructure.

By satisfying both of these conditions regarding the microstructure after annealing and rolling reduction ratio, it becomes possible to appropriately control the dispersion of the non-recrystallized microstructure at the time of the subsequent final annealing. It is assumed that this is because refining the structure at an intermediate stage of the process, and introducing sufficient strains by rolling work causes the recrystallization nucleus in final annealing to be dispersed and increased.

Next, final annealing is performed. It is necessary for the annealing temperature during this process to be 670° C. or higher and 800° C. or lower. This is because at an annealing temperature of lower than 670° C., recrystallization does not sufficiently proceed and magnetic properties may significantly deteriorate, and a sufficient sheet shape correction effect cannot be achieved during continuous annealing, while if the annealing temperature exceeds 800° C., the non-recrystallized microstructure disappears and causes strength degradation.

Further, from the perspective of achieving a recrystallization ratio of 30% or more, the annealing duration must be 2 seconds or longer, while from the perspective of achieving a recrystallization ratio of 95% or less, the annealing duration must be 1 minute or shorter.

Under the above described condition with an annealing temperature of 670° C. or higher and 800° C. or lower, and annealing duration of 2 seconds or longer and 1 minute or shorter, an annealing condition where the area ratio of recrystallized grains in the cross section of the rolling direction of the steel sheet after final annealing is 30% to 95%, and the length in the rolling direction of a connected non-recrystallized grain group is 2.5 mm or less, is selected.

It is advantageous to apply insulating coating on the surface of the steel sheet after the above described final annealing to reduce iron loss. At this time, to ensure good punchability, organic coating containing a resin is preferably applied, while if greater importance is placed on weldability, semi-organic or inorganic coating is preferably applied.

As mentioned above, it is also helpful to reduce as much iron loss as possible in a state where the non-recrystallized microstructure of the product steel sheet is utilized to ensure high strength. To reduce iron loss in such conditions, larger recrystallized grains of the product steel sheet are more preferred and, for that, it is effective to improve grain growth properties. It is also necessary to minimize precipitates inhibiting grain growth properties. However, producing a steel sheet with minimized precipitates (i.e. reduced Mn) causes a problem in that sheet fracture occurs during hot rolling. To solve this problem, the addition of Ca is extremely effective. Further, variation in mechanical properties is reduced and, therefore, it becomes possible to reduce iron loss as much as possible within the condition which enables obtaining sufficient mechanical properties.

EXAMPLES

Example 1

Steel slabs, each having a thickness of 200 mm and the chemical composition indicated in Table 2, were subjected to heating, hot rolling, hot band annealing, pickling, then cold rolling until reaching a thickness of 0.35 mm, and subsequent final annealing, in the conditions shown in Table 3. However, regarding steel sample A, since a crack was generated in the hot-rolled sheet, processes following hot band annealing were not performed. In hot rolled sheets of steel samples B and C, no cracks were generated.

Regarding steel samples B and. C, samples after hot band annealing and after final annealing were polished in the cross sections in the rolling direction (cross sections orthogonal to the sheet transverse direction) of the steel sheets, etched, and observed with an optical microscope to obtain the average grain size (nominal grain size) of the recrystallized grains from the recrystallization ratio (area ratio) and planimetry. Further, regarding the cross sectional structure in the rolling direction after final annealing, lengths in the rolling direction of 10 or more non-recrystallized grain groups were measured to obtain the mean value.

Further, magnetic properties and mechanical properties of the obtained product steel sheets were examined. Magnetic properties were evaluated based on W10/400 (iron loss when excited at flux density: 1.0 T and frequency: 400 Hz) of L+C properties (which were measured using the same number of samples in rolling direction (L) and transverse direction (C)) obtained by cutting out and measuring Epstein test specimens in the rolling direction (L) and the transverse direction (C). Regarding mechanical properties, five sheets of JIS No. 5 tensile test specimens were cut out from each of the rolling direction (L) and the transverse direction (C) and tensile tests were conducted to investigate mean values and variation of tensile strength (TS).

The obtained evaluation results are shown in Table 4.

The variation was evaluated with standard deviation a and shown as 2a in table 4. If 2σ is 40 MPa or less, variation is considered small. Regarding these samples, the result of investigating the relation between the length in the rolling direction of each elongated non-recrystallized grain group and 2σ of tensile strength, is shown in Table 3.

TABLE 2

| Steel Sample | Chemical Composition (mass %) | | | | | | | | | | |
|---|---|---|---|---|---|---|---|---|---|---|---|
| ID | C | Si | Mn | Al | P | S | N | Sn | Sb | Ca | Remarks |
| A | 0.0017 | 3.64 | 0.027 | 0.0008 | 0.02 | 0.0018 | 0.0018 | 0.040 | — | — | Comparative Steel |
| B | 0.0017 | 3.69 | 0.029 | 0.0009 | 0.02 | 0.0019 | 0.0019 | 0.040 | — | 0.0031 | Conforming Steel |
| C | 0.0019 | 3.66 | 0.030 | 0.0009 | 0.02 | 0.0018 | 0.0018 | — | 0.025 | 0.0031 | Conforming Steel |

TABLE 3

| No. | Steel Sample ID | Cumulative Rolling Reduction Ratio of Rough Rolling (%) | Rolling Reduction Ratio of Final Pass in Rough Rolling (%) | Slab Reheating Temperature (° C.) | Thickness of Hot Rolled Sheet (mm) | Hot Band Annealing Temperature (° C.) | Recrystallized Grain Size After Hot Band Annealing (μm) | Recrystallization Ratio After Hot Band Annealing (%) |
|---|---|---|---|---|---|---|---|---|
| 1 | A | 75 | 27 | 1100 | 1.9 | Crack Generated in Hot Rolled Sheet | | |
| 2 | B | 70 | 23 | 1100 | 1.9 | 910 | 110 | 100 |
| 3 | B | 75 | 23 | 1100 | 1.9 | 910 | 105 | 100 |
| 4 | B | 75 | 27 | 1100 | 1.9 | 830 | 35 | 70 |
| 5 | B | 75 | 27 | 1100 | 1.9 | 910 | 105 | 100 |
| 6 | B | 75 | 27 | 1100 | 1.9 | 990 | 295 | 100 |
| 7 | B | 75 | 27 | 1100 | L9 | 1050 | 470 | 100 |
| 8 | B | 75 | 27 | 1100 | 1.9 | 910 | 115 | 100 |
| 9 | B | 75 | 27 | 1100 | 1.7 | 910 | 120 | 100 |
| 10 | C | 70 | 23 | 1100 | 1.9 | 990 | 295 | 100 |
| 11 | C | 75 | 27 | 1100 | 1.9 | 990 | 290 | 100 |
| 12 | C | 75 | 27 | 1100 | 1.9 | 990 | 290 | 100 |
| 13 | C | 75 | 27 | 1100 | 1.9 | 990 | 295 | 100 |
| 14 | C | 75 | 27 | 1100 | 1.9 | 990 | 295 | 100 |
| 15 | C | 73 | 26 | 1100 | 1.9 | 990 | 285 | 100 |

| No. | Thickness of Cold Rolled Sheet (mm) | Rolling Reduction Ratio of Cold Rolling (%) | Final Annealing Temperature (° C.) | Recrystallization Ratio After Final Annealing (%) | Recrystallized Grain Size After Final Annealing (μm) | Length of Connected Non-Recrystallized Grain Group After Final Annealing (mm) | Remarks |
|---|---|---|---|---|---|---|---|
| 1 | Crack Generated in Hot Rolled Sheet | | | | | | Comparative Example |
| 2 | 0.35 | 81.6 | 710 | 69 | 31 | 2.75 | Comparative Example |
| 3 | 0.35 | 81.6 | 710 | 71 | 31 | 2.25 | Inventive Example |
| 4 | 0.35 | 81.6 | 710 | 70 | 33 | 2.80 | Comparative Example |
| 5 | 0.35 | 81.6 | 710 | 73 | 35 | 1.30 | Inventive Example |
| 6 | 0.35 | 81.6 | 710 | 77 | 34 | 1.85 | Inventive Example |

TABLE 3-continued

| | | | | | | | |
|---|---|---|---|---|---|---|---|
| 7 | 0.35 | 81.6 | 710 | 75 | 36 | 2.80 | Comparative Example |
| 8 | 0.30 | 84.2 | 710 | 79 | 40 | 1.20 | Inventive Example |
| 9 | 0.35 | 79.4 | 710 | 51 | 36 | 2.65 | Comparative Example |
| 10 | 0.35 | 81.6 | 690 | 33 | 28 | 2.60 | Comparative Example |
| 11 | 0.35 | 81.6 | 660 | 28 | 13 | 2.90 | Comparative Example |
| 12 | 0.35 | 81.6 | 690 | 35 | 27 | 2.35 | Inventive Example |
| 13 | 0.35 | 81.6 | 790 | 80 | 44 | 1.90 | Inventive Example |
| 14 | 0.35 | 81.6 | 820 | 96 | 50 | 0.90 | Comparative Example |
| 15 | 0.35 | 81.6 | 790 | 82 | 46 | 2.00 | Inventive Example |

Note)
Annealing duration of hot band annealing was adjusted to 30 seconds to 120 seconds. Annealing duration of final annealing was adjusted to 5 seconds to 50 seconds.

TABLE 4

| No. | Steel Sample ID | Average Value of TS (MPa) | 2 × "Standard Deviation of TS" (MPa) | $W_{10/400}$ (W/kg) | Remarks |
|---|---|---|---|---|---|
| 1 | A | Crack Generated in Hot Rolled Sheet | | | Comparative Example |
| 2 | B | 664 | 65 | 24.9 | Comparative Example |
| 3 | B | 662 | 31 | 24.7 | Inventive Example |
| 4 | B | 679 | 155 | 26.9 | Comparative Example |
| 5 | B | 660 | 20 | 24.6 | Inventive Example |
| 6 | B | 652 | 27 | 25.9 | Inventive Example |
| 7 | B | 659 | 97 | 25.7 | Comparative Example |
| 8 | B | 655 | 19 | 20.0 | Inventive Example |
| 9 | B | 680 | 95 | 32.3 | Comparative Example |
| 10 | C | 685 | 70 | 29.7 | Comparative Example |
| 11 | C | 775 | 102 | 39.0 | Comparative Example |
| 12 | C | 695 | 35 | 29.5 | Inventive Example |
| 13 | C | 628 | 27 | 23.2 | Inventive Example |
| 14 | C | 580 | 20 | 21.1 | Comparative Example |
| 15 | C | 626 | 31 | 22.9 | Inventive Example |

Figure 3:
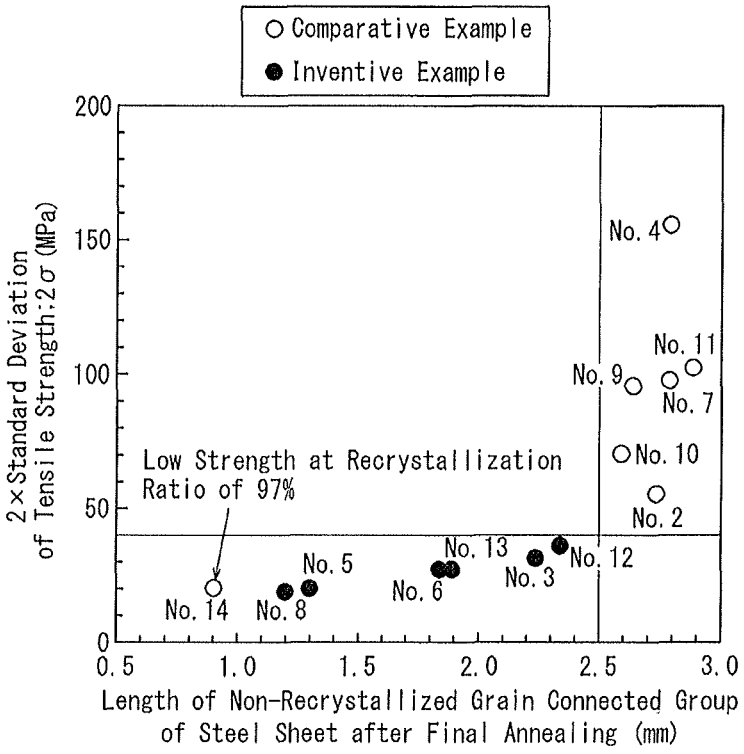
FIG. 3 is a graph showing the relation between the length in the rolling direction of a non-recrystallized grain group, and 2σ of tensile strength.

As shown in Table 4 and FIG. 3, Nos. 2 to 9 which use steel sample B are mainly different from each other in hot band annealing temperature, and the TS mean value thereof is 650 MPa or more which is an extremely high strength compared to normal electrical steel sheets. However, there is a large variation of TS in Nos. 2, 4, 7, and 9 where the length of the connected non-recrystallized grain group of each final annealed sheet exceeds 2.5 mm, which is outside of the range of the invention. Among these, No. 9 has a low cold rolling reduction ratio and it is difficult to appropriately control the dispersion of the non-recrystallized microstructure. Therefore, it was necessary to select the final annealing temperature etc. so that the length of the connected non-recrystallized grain group of the final annealed sheet is within the range of the present invention.

On the contrary, in Nos. 3, 5, 6, and 8 where the length of the connected non-recrystallized grain group of the final annealed sheet is 2.5 mm or less which is within our range, the variation of TS in 2a is 35 MPa or less which is extremely small.

Further, Nos. 10 to 14 which use steel sample C are mainly different from each other in final annealing temperature. Regarding No. 10, the cumulative rolling reduction ratio of rough rolling is 70% which is low and outside of our range, and there is a large variation in TS. Regarding No. 11, the final annealing temperature is 660° C. which is low, the recrystallization ratio of the final annealed sheet is 28%, the recrystallized grain size of the final annealed sheet is 13 μm which is outside of our range, and iron loss is high. Further, regarding No. 14, the final annealing temperature is 820° C. which is high, the recrystallization ratio of the final annealed sheet is 96% which is outside of our range, and the mean value of TS is low.

On the contrary, Nos. 12, 13, and 15 which are within our range exhibit good results in iron loss, mean value of TS, and variation of TS.

As it is clear from the relation between the length of the non-recrystallized grain group obtained from microstructure observation of the cross section of the rolling direction and standard deviation 2a of tensile strength shown in FIG. 3, variation is significantly reduced particularly when the length of the non-recrystallized grain group is 2.5 mm or less.

Example 2

Steel slabs with chemical compositions shown in Table 5 were used to produce electrical steel sheets in the following conditions.

Slab reheating temperature: 1060° C. to 1120° C., cumulative rolling reduction ratio in rough rolling during hot rolling: 80%, rolling reduction ratio of final pass: 30%, thickness of hot rolled sheet: 2.0 mm, hot band annealing temperature: 950° C. to 1000° C., hot band annealing duration: 2 minutes, recrystallization area ratio after hot band annealing: 100%, recrystallized grain size after hot band annealing: 200 μm to 280 μm, sheet thickness after final cold rolling: 0.35 mm, final annealing temperature: 720° C. to 760° C., final annealing duration: 10 seconds, recrystallization area ratio after final annealing: 75% to 85%, length of the non-recrystallized grain group after final annealing: 1 mm to 2 mm. Regarding steel sample F, a crack was generated during cold rolling, and the following processes were cancelled.

Regarding the other electrical steel sheets, magnetic properties (L +C properties) and the mean values and variation of tensile strength (TS) were investigated. The evaluation was conducted with the same method as Example 1. Further, measurement of recrystallization ratio after annealing and average grain size of recrystallized grains, and measurement of length in the rolling direction of non-recrystallized grain group after final annealing for samples after hot band annealing and after final annealing, were performed with the same method as Example 1.

The obtained results are shown in Table 6.

TABLE 5

| No. | Steel Sample ID | Chemical Composition (Mass %) C | Si | Mn | Al | P | S | N | Sn | Sb | Ca | Remarks |
|---|---|---|---|---|---|---|---|---|---|---|---|---|
| 1 | D | 0.0016 | 3.78 | 0.025 | 0.0009 | 0.02 | 0.0017 | 0.0020 | 0.045 | — | 0.0035 | Conforming Steel |
| 2 | E | 0.0020 | 3.68 | 0.031 | 0.0002 | 0.02 | 0.0019 | 0.0018 | — | 0.024 | 0.0028 | Conforming Steel |
| 3 | F | 0.0019 | 5.31 | 0.037 | 0.0015 | 0.02 | 0.0019 | 0.0019 | 0.020 | — | 0.0040 | Comparative Steel |
| 4 | G | 0.0038 | 4.42 | 0.048 | 0.0018 | 0.02 | 0.0020 | 0.0018 | 0.027 | — | 0.0030 | Conforming Steel |
| 5 | H | 0.0018 | 3.22 | 0.025 | 0.0009 | 0.02 | 0.0021 | 0.0019 | 0.020 | — | 0.0033 | Comparative Steel |
| 6 | I | 0.0025 | 3.61 | 0.095 | 0,0008 | 0.02 | 0.0028 | 0.0036 | 0.015 | 0.015 | 0.0016 | Conforming Steel |
| 7 | J | 0.0020 | 3.87 | 0.135 | 0.0009 | 0.02 | 0.0025 | 0,0019 | 0.026 | 0.024 | 0.0016 | Comparative Steel |
| 8 | K | 0.0023 | 3.60 | 0.081 | 0.0011 | 0.02 | 0.0021 | 0.0019 | 0.051 | — | 0.0024 | Conforming Steel |
| 9 | L | 0.0019 | 3.65 | 0.078 | 0.0023 | 0.02 | 0.0020 | 0.0021 | 0.040 | — | 0.0025 | Comparative Steel |
| 10 | M | 0.0020 | 3.68 | 0.057 | 0.0010 | 0.02 | 0.0043 | 0.0021 | — | 0.022 | 0.0028 | Comparative Steel |

TABLE 6

| No. | Steel Sample ID | Average Value of TS (MPa) | 2 × "Standard Deviation of TS" (MPa) | $W_{10/400}$ (W/kg) | Remarks |
|---|---|---|---|---|---|
| 1 | D | 661 | 26 | 24.8 | Conforming Steel |
| 2 | E | 655 | 28 | 25.9 | Conforming Steel |
| 3 | F | Crack Generated during Cold Rolling | | | Comparative Steel |
| 4 | G | 715 | 26 | 23.1 | Conforming Steel |
| 5 | H | 566 | 30 | 30.1 | Comparative Steel |
| 6 | I | 646 | 27 | 26.3 | Conforming Steel |
| 7 | J | 668 | 41 | 30.0 | Comparative Steel |
| 8 | K | 650 | 28 | 27.2 | Conforming Steel |
| 9 | L | 653 | 43 | 31.2 | Comparative Steel |
| 10 | M | 653 | 42 | 31.2 | Comparative Steel |

As it is clear from Table 6, the examples having the chemical compositions and steel microstructures satisfying our conditions have extremely small variation in TS and show stable properties.

INDUSTRIAL APPLICABILITY

It is possible to stably obtain a high strength non-oriented electrical steel sheet with not only excellent magnetic properties but excellent strength properties with small variation, and suitably apply the obtained sheet to applications such as a rotor material for a high speed motor.

The invention claimed is:

1. A method of producing an electrical steel sheet comprising:

heating a slab having a chemical composition including by mass %

C: 0.0050% or less,

Si: more than 3.5% to 5.0%,

Mn: 0.10% or less,

Al: 0.0020% or less,

P: 0.030% or less,

N: 0.0040% or less,

S: 0.0005% to 0.0030%, and

Ca: 0.0015% or more, and further at least one element selected from

Sn: 0.01% to 0.1%, and

Sb: 0.01% to 0.1%, and balance including Fe and incidental impurities;

subjecting the slab to hot rolling consisting of rough rolling and finish rolling to obtain a hot rolled steel sheet;

subjecting the steel sheet to subsequent hot band annealing and pickling;

subjecting the steel sheet to a single cold rolling to have a final sheet thickness; and subjecting the steel sheet to final annealing to produce an electrical steel sheet, wherein 1) a cumulative rolling reduction ratio in the rough rolling is 73.0% or more, 2) in the hot band annealing, an annealing condition is selected that satisfies an area ratio of recrystallized grains in a cross section in a rolling direction of a steel sheet after the hot band annealing of 100%, and a recrystallized grain size of 80 μm to 300 μm, under a condition where annealing temperature is 850° C. to 1000° C., and annealing duration is 10 seconds to 10 minutes, and 3) in the final annealing, an annealing condition is selected that satisfies an area ratio of recrystallized grains in a cross section in the rolling direction of a steel sheet after the final annealing of 30% to 95%, and a length in the rolling direction of a connected non-recrystallized grain group of 2.5 mm or less, under a condition where annealing temperature is 670° C. to 800° C., and annealing duration is 2 seconds to 1 minute.

2. The method according to claim 1, wherein a rolling reduction ratio of final pass in the rough rolling is 25% or more.

3. The method according to claim 1, wherein an average grain size of recrystallized grains in a cross section in the rolling direction of the steel sheet after the final annealing is 15 μm or more.

4. The method according to claim 1, wherein a rolling reduction ratio in the cold rolling is 80% or more.

5. The method according to claim 2, wherein an average grain size of recrystallized grains in a cross section in the rolling direction of the steel sheet after the final annealing is 15 μm or more.

6. The method according to claim 2, wherein a rolling reduction ratio in the cold rolling is 80% or more.

7. The method according to claim 3, wherein a rolling reduction ratio in the cold rolling is 80% or more.

8. The method according to claim 5, wherein a rolling reduction ratio in the cold rolling is 80% or more.

* * * * *